United States Patent [19]

Steinbach

[11] 4,132,092

[45] Jan. 2, 1979

[54] PROTECTIVE COVER FOR A HANDLE LOCK

[75] Inventor: Robert L. Steinbach, Chicago, Ill.

[73] Assignee: Chicago Lock Co., Chicago, Ill.

[21] Appl. No.: 897,335

[22] Filed: Apr. 18, 1978

[51] Int. Cl.[2] ..... E05B 13/00

[52] U.S. Cl. ..... 70/208; 70/417

[58] Field of Search ..... 70/208, 417, DIG. 56, 70/DIG. 58

[56] References Cited

U.S. PATENT DOCUMENTS

| | | | |
|---|---|---|---|
| 1,932,048 | 10/1933 | Robertson | 70/208 |
| 3,299,678 | 1/1967 | Spencer | 70/208 |
| 3,834,198 | 9/1974 | Wiczer | 70/208 |

FOREIGN PATENT DOCUMENTS

| | | | |
|---|---|---|---|
| 1179411 | 1/1970 | United Kingdom | 70/208 |

*Primary Examiner*—Robert L. Wolfe
*Attorney, Agent, or Firm*—Norman H. Gerlach

[57] ABSTRACT

A protective cover is provided for a handle lock. The handle lock includes a handle housing, a closure handle, and a lock mechanism. The housing includes a tubular receptacle extending into a door or other closure, and a lateral flange on the receptacle supporting the housing on the outer surface of the closure. The closure handle has a stem received in the receptacle and a grip on the outer end of the stem, the handle being movable inwardly and outwardly with respect to the housing between an inner locked position wherein the grip is adjacent to the flange, and an outer operating position. The lock mechanism is carried by the handle and is cooperative in the locked position with structure on the housing, for locking the handle to the housing. The protective cover includes a mounting plate having an opening receiving the receptacle therethrough, while the flange secures the plate to the closure, and a casing mounted on the plate and continuously surrounding the flange and the grip in the locked position. The casing has a handle-movement opening permitting movement of the handle between the locked and operating positions, the grip being disposed outwardly of the casing in the operating position. The casing lies closely adjacent to the grip around the periphery of the handle-movement opening in the locked position. The cover prevents prying on the grip and thwarts any attempt to defeat the lock in this manner.

16 Claims, 7 Drawing Figures

PROTECTIVE COVER FOR A HANDLE LOCK

BACKGROUND OF THE INVENTION

This invention relates to a protective cover for a handle lock, such as employed commonly on the closures of vending machines, coin changers, and similar machines.

A handle lock is an assembly of a handle housing, a closure handle, and locking means. The housing includes a tubular receptacle which extends into the closure when mounted, and a flange which projects laterally outwardly from the receptacle, for supporting the housing thereby on the outer surface of the closure. The closure handle includes a stem or body received in the receptacle, and a grip on the outer end of the stem for manual operation of the handle. The handle is movable inwardly and outwardly with respect to the housing, between an inner locked position wherein the grip is adjacent to the flange and an outer operating position. Locking means such as a cylinder lock is carried by the handle and cooperates in the locked position with means on the housing for locking the handle to the housing. A popular lock structure employs a "pop-out" rotatable handle, which is a handle spring-pressed to move outwardly from the housing when the locking means is unlocked or released from its engagement with the housing. U.S. Pat. Nos. 3,122,012 and 3,089,329 illustrate handle locks of the foregoing description.

Owing to the nature of their structures, the handle housing and the closure handle are constructed by die casting and are relatively brittle. The flange of the housing includes a rim which projects outwardly to enclose a portion of the handle grip where it adjoins the housing in the locked position, in popular models. The locks have been defeated in the past by chipping away this rim, laterally inserting a prying tool behind the grip, and then prying on the grip to pry the handle away from the housing. The force exerted sheared a lock bolt forming part of the locking means. Also, projecting portions of the grip were engaged by a pulling tool, in an effort to pull the handle outwardly while shearing the lock bolt.

In an effort to prevent the handle locks from being defeated in the foregoing manner, a steel box has been installed around the housing flange and the handle grip of each lock for protection. A steel cover plate is hinged to one side of the box and serves an access opening at the face thereof. The cover plate is padlocked to the box when the handle lock is not being operated, for preventing access to the handle lock.

The foregoing protective structure has not proved to be completely effective, however. Persons intent on gaining unauthorized access to the locked machines have been able to remove the padlocks relatively easily, after which they have pried open the handle locks as before, there being ample space within the box to insert and operate a prying tool. Moreover, this system requires a second lock and key for each handle lock.

SUMMARY OF THE INVENTION

The present invention provides a protective cover for a handle lock which prevents insertion and operation of a prying tool behind the handle grip. The structure of the cover preferably is such that it serves also to prevent gripping engagement of a pulling tool or the like with the handle.

The new protective cover may be supplied with new handle locks and machines equipped with the same, and, also, it may be employed on existing locks and machines, generally with no requirement for alteration of either the locks or the machines. The cover may be employed with the locks of different manufactures, and it readily may be manufactured in different sizes and shapes.

The protective cover is relatively simple and consists essentially of but two parts, which may be manufactured conveniently and economically. Assembly of the cover on new or existing equipment is rapid, requires little skill, and involves but little labor. The overall cost of providing the protection is small, especially in relation to the reduced losses and reduced damage to the handle locks and the machines on which they are mounted.

The protective cover of the invention is employed on a handle lock which includes a handle housing adapted to be mounted on a closure and having a tubular receptacle which extends into the closure when mounted, a flange projecting laterally outwardly from the receptacle for supporting the housing thereby on the outer surface of the closure, and means cooperative with fastening means for securing the housing to the closure; a closure handle having a stem received in the receptacle and a grip on the outer end of the stem for manual operation of the handle, the handle being movable inwardly and outwardly with respect to the housing between an inner locked position wherein the grip is adjacent to the flange and an outer operating position; and locking means carried by the handle and cooperative in the locked position with means on the housing for locking the handle to the housing. The protective cover includes a mounting plate having an opening for receiving the receptacle extending therethrough when the cover is in use with the lock mounted on a closure, with the plate engaging the inner surface of the flange to secure the plate to the closure; a one-piece casing adapted to be mounted on the plate in said use to continuously surround the flange and the grip in the locked position, the casing having a handle-movement opening affording access to the locking means in the locked position and permitting movement of the handle between the locked and operating positions, the grip being disposed outwardly of the casing in the operating position, the casing also being adapted to lie closely adjacent to the grip around the periphery of the handle-movement opening in the locked position for preventing insertion and operation of a prying tool behind the grip; and means for rigidly connecting the casing to the plate.

In a preferred embodiment of the invention, the casing further is adapted to enclose the grip in the locked position so as to prevent operative engagement of a pulling tool with the grip. In a further preferred embodiment, additional security is provided by means forming in the casing a recess in which the plate is adapted to be received completely in use.

BRIEF DESCRIPTION OF THE DRAWINGS

The attached drawings illustrate a preferred embodiment of the protective cover of the invention as it is employed with a handle lock, without limitation to either of the illustrative structures. In the drawings, like elements are identified by like reference symbols in each of the views, and:

FIG. 6 is a fragmentary side elevational view of the assembly, with parts broken away and in section, in the locked condition of the handle lock, illustrating the assembly mounted on a door panel or the like.

DESCRIPTION OF THE PREFERRED EMBODIMENT

Figure 1:
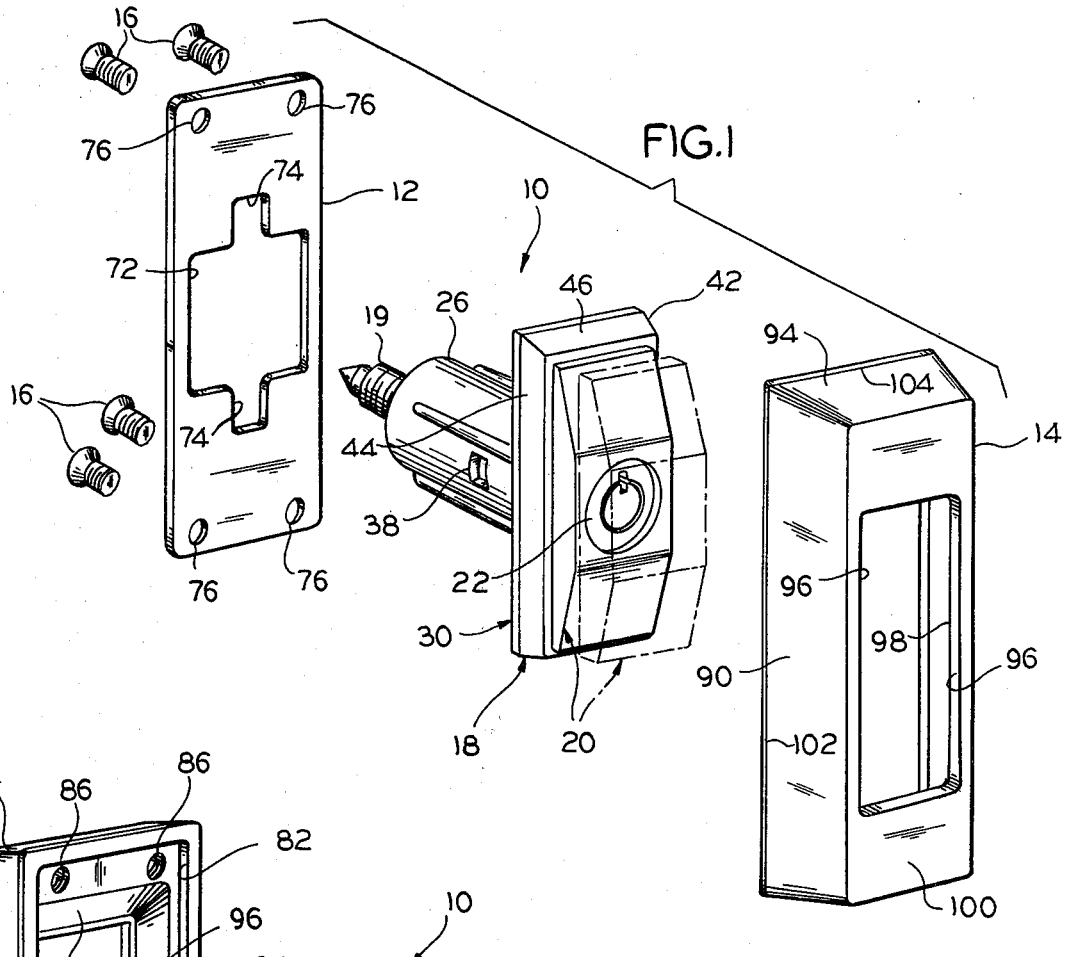
FIG. 1 is a front and side exploded perspective view of an assembly of a handle lock and a protective cover therefor, in accordance with the invention, in which the handle of the lock is illustrated in its inner locked position in full lines, and in its outer operating position in phantom lines.

Referring to the drawings, a protective cover 8 constructed in accordance with the invention is illustrated in an assembly with a handle lock 10. The cover 8 includes a mounting plate 12, a one-piece casing 14, and fasteners in the form of screws 16. The handle lock 10 is a conventional lock of the type disclosed in U.S. Pat. No. 3,122,012, and, in general, it is constructed and functions in the same manner. It includes a handle housing 18, a lock shaft 19, a closure handle 20, and locking means including a cylinder lock mechanism 22 carried by the handle 20.

Referring to FIGS. 1, 2, and 5–7, the handle housing 18 is illustrated as mounted on the outer panel 24 of a door or other closure. The housing includes a tubular receptacle 26 which extends into the closure when mounted, through a conforming opening 28 therein, and a flange 30 which is integral with and projects laterally outwardly from the receptacle 26 for supporting the housing 18 thereby on the outer surface of the closure panel 24.

Figure 2:
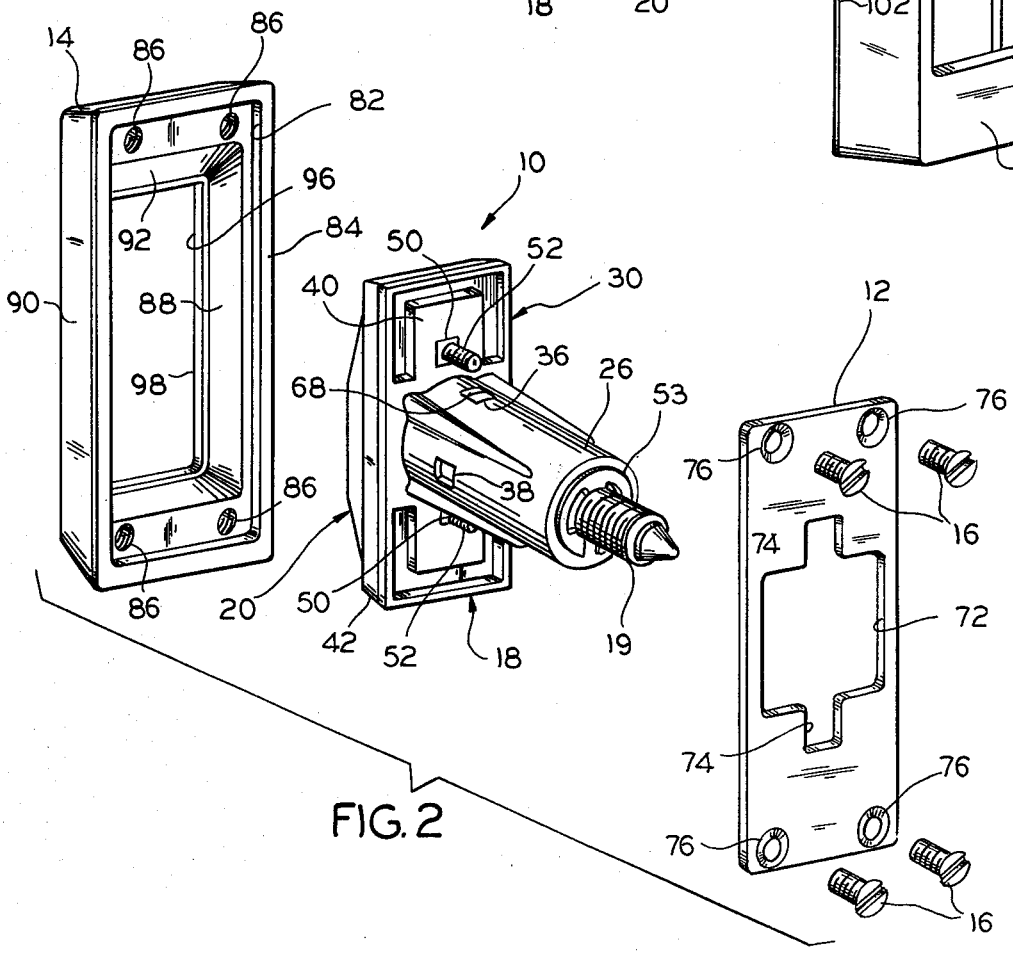
FIG. 2 is a rear and side exploded perspective view of the assembly.
Figure 6:
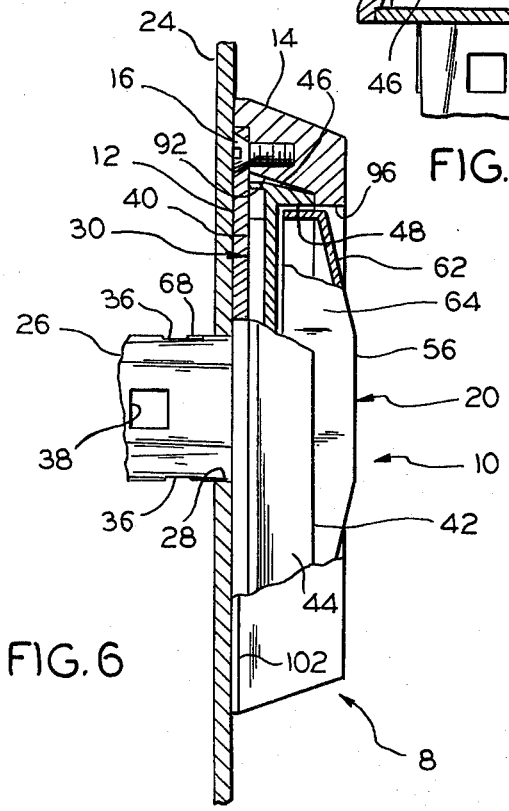
Figure 7:
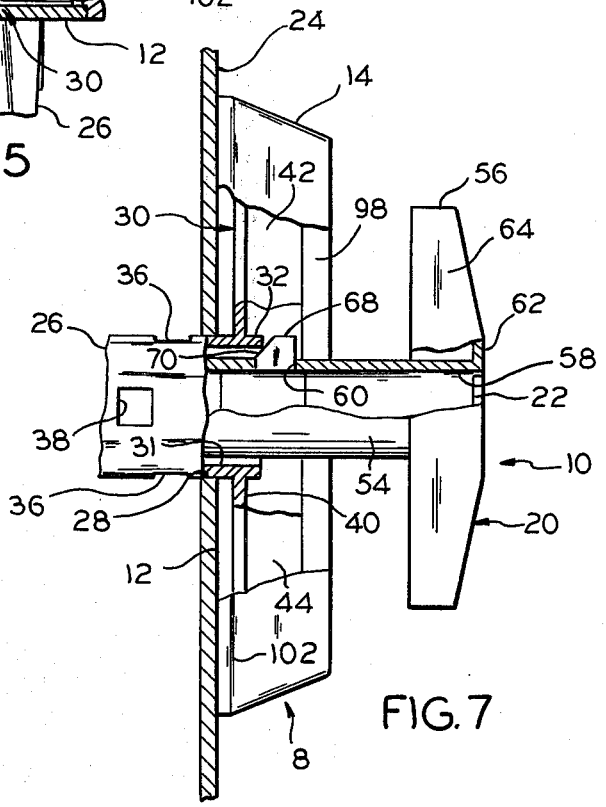
FIG. 7 is a fragmentary side elevational view, with parts broken away and in section, similar to FIG. 6 but illustrating the handle lock in its operating condition.

Referring to FIG. 7, the receptacle 26 has a cylindrical bore 31, which terminates in an outer open end defined by a collar portion 32 integral with the flange 30. Referring to FIG. 2, the inner opposite end of the receptacle 26 is closed, except for an opening through which the lock shaft 19 is inserted rotatably. The receptacle 26 is provided with a pair of diametrically opposed substantially rectangular lock bolt openings 36 (FIGS. 2 and 5–7) which are relatively near to and spaced from the flange 30, and a second pair of diametrically opposed lock bolt openings 38 which are more distant from the flange 30 and are rotated 90° with respect to the openings of the first pair.

The flange 28 includes a rectangular contoured base portion 40, which is integral with the collar 32 therearound. The flange 30 also includes a substantially rectangular peripheral rim portion 42 which is integral with the outer edge of the base portion 40 therearound. The rim portion 42 has outwardly convergent sloping side surfaces 44 and outwardly covergent sloping end surfaces 46 (see FIGS. 1 and 5). The base portion 40 and the rim portion 42 together define a forwardly facing grip-receiving well, pocket or recess 48 (FIG. 6) in the flange 30.

Two substantially square fastener mounting holes 50 (FIG. 2) are formed in the base portion 40, on opposite sides of the receptacle 26. A mounting bolt 52 is non-rotatably mounted in each of the fastener mounting holes 50, the bolt being provided with a square head portion corresponding to the outline of the hole. The bolts 52 serve for rigidly connecting the handle housing 18 to the door panel 24, in a conventional manner. At times, a steel backup plate, not shown, is employed behind the door panel 24, and the bolts 52 or the like secure the housing 18 both to the panel 24 and to the backup plate.

The lock shaft 19 is secured against movement in the axial direction on the receptacle 26 by a split snap ring 53 seated in a groove in the shaft, and other structure, as disclosed in the aforesaid U.S. Pat. No. 3,122,012. The illustrative lock shaft 19 is threaded for engagement with a nut or the like (not illustrated) which is secured on a cabinet body or other structure to which the door is attached. Alternatively, other conventional interengaging door-holding or latching structure may be employed, such as a locking cam mounted on a lock shaft in the handle lock, which engages a suitable holding member on a cabinet.

Referring to FIG. 7, the closure handle 20 includes a generally cylindrical tubular stem or shank 54 and a transversely extending generally rectangular grip 56 integral with the outer end of the stem 54 therearound. The stem 54 has a cylindrical bore 58, and a rectangular bolt opening 60 in the wall thereof. The stem 54 is received rotatably in the bore 31 of the housing receptacle 26 and also is axially reciprocally movable therein. The bolt opening 60 in the stem is arranged to register with one or the other of the receptable bolt openings 36 which are nearer to the flange 30. The more distant receptacle bolt openings 38 are provided for use with other handle and lock mechanism structures and arrangements, not illustrated.

The grip 56 includes a shaped rectangular (in plan view) base portion 62 integral with the stem 54 around the mouth of the bore 58, and an inwardly extending peripheral rim portion 64 integral with the base portion 62, extending therearound, and having the rectangular outline thereof. The handle 20 is manually movable upon grasping the grip 56, inwardly and outwardly with respect to the housing 18, between an inner locked position and an outer operating position. In the locked position, illustrated in FIG. 6, the grip 56 is received in the well 48, and the inner edge of the rim portion 64 of the grip is adjacent to the base portion 40 of the flange. The rim portion 64 of the grip is closely received within the rim portion 42 of the flange. A portion of the grip 56 projects outwardly beyond the flange rim portion 42. In the operating position, illustrated in FIG. 7, the grip 56 is spaced outwardly from the flange rim portion 42 and also from the casing 14, the latter as described hereinafter.

The stem 54 of the handle 20 is detachably engageable with the lock shaft 19, within the receptacle 26, for operational and locking purposes, in the manner disclosed in U.S. Pat. No. 3,122,012. Thus, the stem 54 is disengaged from the lock shaft 19 in the inner locked position of the handle 20, and the stem engages the lock shaft in the outer locked position of the handle. The handle is biased outwardly by the pressure of a spring (not shown) contained in the receptacle and bearing on the stem 54, as disclosed in the latter patent.

The cylinder lock mechanism 22 is received in the bore 58 of the handle stem 54. A suitable lock mechanism may be selected from the prior art, a specific example being illustrated in U.S. Pat. No. 4,083,211. The lock mechanism includes a spring-pressed radially sliding lock bolt 68, and the mechanism is mounted in the handle stem 54 so that the lock bolt extends through the bolt opening 60 in the stem wall and projects outwardly therefrom. When the opening 60 is in register with one of the receptacle bolt openings 36, and the lock mechanism 22 is in its locking condition, the lock bolt 68 also projects into the receptacle opening 36, as illustrated in FIG. 2, where it engages the edge of the receptacle 26 bordering the opening 36, for locking the handle 20 to the housing 18.

In the locked condition of the handle lock 10, shown in FIG. 6, the handle 20 is disposed in its inner locked position, with the grip 56 received within the flange well 48 and the lock bolt 68 engaging the receptacle 26. In use, when it is desired to open the door on which the lock 10 is mounted, the lock is operated by inserting a suitable tubular key (not shown) in the outer end of the lock mechanism 22. The key is turned to withdraw the lock bolt 68 from the receptacle bolt opening 36, whereupon the handle 20 under spring pressure pops out of the housing 18, into the operating position shown in FIG. 7. The lock bolt 68 is disposed outwardly of the receptacle collar 32 at this time. The handle then may be turned manually, grasping the grip 56 for that purpose, thereby to turn the lock shaft 19 for the purpose of opening the door.

When the door is to be closed and locked, the handle 20 is turned in the opposite direction, to provide the proper threaded engagement of the lock shaft 19 with the companion nut on the cabinet body. The grip 56 of the handle 20 then is aligned with the well 48 in the flange 30, proper alignment being made possible by a lost-motion connection between the stem 54 and the shaft 19, as described in U.S. Pat. No. 3,122,102. With the key removed and the lock bolt 68 projecting as illustrated in FIG. 7, the handle 20 is pushed inwardly, causing an inclined surface 70 on the lock bolt 68 to contact the collar 32, which cams the bolt inwardly, so that it may enter the bore 31 of the receptacle 26. Continued inward movement of the handle 20 brings the lock bolt 68 to one of the receptacle bolt openings 36, at which time the bolt under spring pressure moves outwardly into the opening 36 and once more locks the handle to the housing 18.

In the past, the handle lock 10 employed without a protective cover, i.e., as shown in FIGS. 1 and 2 but without the mounting plate 12 and the casing 14, was breached by chipping away the rim portion 42 of the flange 30, to expose the joint between the base portion 40 of the flange and the rim portion 64 of the grip 56, or both the rim portion 42 and the base portion 40 were chipped away. Then, a prying tool was driven behind the rim portion 64 of the grip 56, and the handle 20 was pried away from the housing 18, shearing the lock bolt 68 in the process. The handle 20 then could be moved outwardly and engaged with the lock shaft 19, for opening the door. It was also attempted to accomplish the same result by clamping the gripping jaws of a pulling tool on the opposite sides of the rim portion 64 of the grip 56, where it projects beyond the rim portion 42 of the flange 30, for pulling the handle 20 away from the housing 18. Such efforts to breach the lock 10 are thwarted by use of the protective cover 8 of the present invention.

Referring particularly to FIGS. 1 and 2, the mounting plate 12 is a rectangular flat plate preferably constructed of cold-rolled steel, which in the illustrative embodiment is 11-gauge. A substantially rectangular receptacle-receiving opening 72 is formed centrally in the mounting plate, and two relatively small bolt openings 74 are formed at opposite ends of the receptacle receiving opening 72 in communication therewith. Four countersunk screw holes 76 are formed adjacent to the corners of the mounting plate.

Referring also to the remaining figures of the drawings for different views, the casing 14 is a one-piece member which in the preferred embodiment is a steel forging at least about $\frac{1}{8}$ inch thick at its thinnest point. The casing 14 includes two opposite generally parallel relatively thick end portions 78 and two opposite elongated generally parallel thinner side portions 80 which are integral with the end portions 78 at the opposite ends of the several portions. A substantially rectangular recess 82 is defined by a substantially rectangular peripheral base portion 84 of the casing, the base portion being integral with the end and side portions 78 and 80 of the casing. Tapped holes 86 extend inwardly from the recess 82 in the enlarged end portions 78, adjacent to the corners of the recess.

The mounting plate 12 is received completely in the casing recess 82 in use, with the screw holes 76 in the plate registering with the tapped holes 86 in the casing 14. The cover screws 16 are inserted through the screw holes 76 and into threaded engagement in the tapped holes 86, for rigidly connecting the casing 14 to the plate 12. In the preferred embodiment, the depth of the recess 82 is slightly greater than the thickness of the mounting plate 12, e.g., 0.005–0.025 inch greater.

Figure 3:
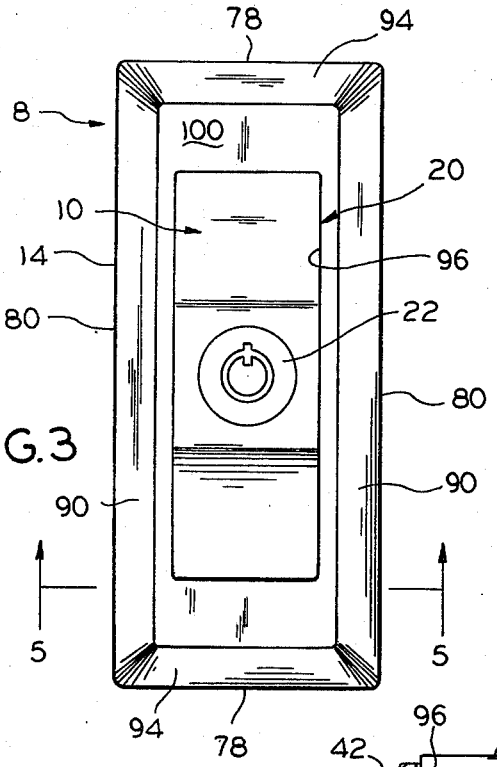
FIG. 3 is a front elevational view of the assembly, in the locked position of the handle.
Figure 4:
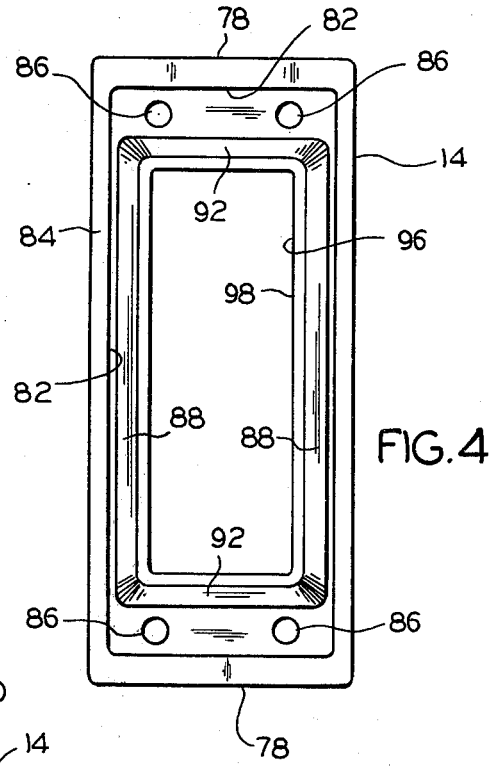
FIG. 4 is a rear elevational view of a casing in the protective cover.
Figure 5:
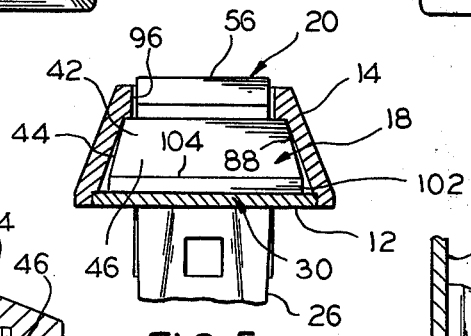
FIG. 5 is a cross sectional and elevational view of the assembly, taken substantially on line 5—5 of FIG. 3.

Referring to FIGS. 3 and 4, the casing 14 is provided with outwardly convergent sloping inner side surfaces 88 and correspondingly convergent sloping outer side surfaces 90, and with outwardly convergent sloping inner end surfaces 92 and correspondingly convergent sloping outer end surfaces 94. The flange rim portion 42 in the housing 18 is received in the casing 14 in nesting relation therein, with the sloping side surfaces 44 of the flange rim portion adjacent to the sloping inner surfaces 88 of the casing, and the sloping end surfaces 46 of the flange rim portion adjacent to the sloping inner end surfaces 92 of the casing in a relatively close fit with slight draft, as seen in FIGS. 5–7.

A laterally inwardly extending peripheral lip 98 integral with the end portions 78 and the side portions 80 at the face of the casing 14 defines a rectangular handle-movement opening 96 in the casing. The inner side and end surfaces 88 and 92 extend between the recess 82 in the base of the casing 14 and the lip 98. The outer surface of the lip 98 forms part of a face surface 100 on the casing 14, which is substantially parallel to the back surface of the casing, on the base portion 84. The outer side surfaces 90 and the outer end surfaces 94 of the casing 14 extend between the face surface 100 and narrow (1/16 inch) flats 102 and 104 (see FIGS. 1, 6 and 7) on the external surfaces and at the edges of the base portion 84.

The lip 98 on the casing 14 projects laterally over the flange rim portion 42 therearound when the flange 30 is received in the casing. In this connection, and referring to dimensions employed in the illustrative preferred embodiment, the handle-movement opening 96 is approximately 0.01 inch longer and wider than the well 48 in the flange 30. The grip 56 is approximately 0.04 inch shorter and approximately 0.03 inch narrower than the well 48 of the flange 30, providing slight clearance between the grip and the flange rim portion 42 at the ends and sides of the grip. The handle-movement opening 96 is approximately 0.04–0.05 inch longer and wider than the grip 56, leaving a clearance of about 0.02–0.025 inch around the grip, between it and the lip 98, when the assembly is in the locked condition illustrated in FIGS. 3, 5 and 6. The peripheral lip 98 on the casing 14 thus lies closely adjacent to the periphery of the grip 56 in the locked position, the slight clearance therebetween, amounting to less than 1/32 inch, being inadequate for effective insertion of a prying tool.

In use, the handle lock 10 and the protective cover 8 are assembled with the flange 28 nesting in the casing 14, as described above, and the receptacle 26 extending through the receptacle-receiving opening 72 in the mounting plate 12. The mounting plate 12 is received in the recess 82 at the base of the casing 14. The cover screws 16 are inserted through the holes 76 in the mounting plate 12 and into the tapped holes 86 in the casing, in tight threaded engagement therein. With the handle 20 in its outer operating position, illustrated in phantom lines in FIG. 1 and in full lines in FIG. 7, but with the grip 56 rotated about 90°, the mounting bolts 52 are inserted through the then-exposed mounting holes 50 in the flange base portion 40 and through registering openings (not shown) in the door panel 24, and the bolts are secured by nuts on the opposite side of the panel. The mounting plate 12 is secured to the panel 24 in this manner, by engagement with the inner or back surface of the flange 30. The casing 14, being rigidly connected to the mounting plate by the screws 16, likewise is secured to the panel 24, with its base portion 84 tightly seated thereon while the mounting plate 12 is held by the casing slightly outwardly from the surface of the panel.

With the handle 20 in the locked position illustrated in FIGS. 3, 5 and 6, the lock 10 is well-protected against break-in attempts. The casing 14 continuously surrounds the flange 30 and the grip 56, preventing access to the inside edge of the rim portion of the grip 56 from the side of or from beneath the grip. The close proximity of the peripheral lip 98 on the casing 14 to the grip 56 prevents effective insertion of a prying tool: a member thin enough to enter the available space breaks upon attempting to impart leverage, and thicker members become wedged between the grip and the casing. Moreover, the fulcrum point for any prying attempt becomes the edge of the handle-movement opening 96 at the face surface 100 of the casing. Consequently, a prying tool cannot be inserted behind the inside edge of the rim portion 64 of the grip 56 and operated to pry the handle 20 away from the housing 18.

The lip 98 on the casing 14 also encloses at least a major part of the area of the grip rim portion 64 that extends outwardly beyond the flange rim portion 42, thereby preventing operative engagement of the grip rim portion 64 by the jaws of a pulling tool. With the mounting plate 12 received in the casing recess 82, there is no exposed joint between the parts of the cover where an attempt may be made to pry the parts apart. The tight abutment of the casing 14 on the panel 24 and the tapered surfaces 90 and 94 on the casing serve to impede more drastic break-in attempts, which might involve application of a tool to the casing 14.

The lock 10 remains operable in the usual manner while encased in the protective cover. Thus, the lock mechanism 22 is accessible for insertion of a key. Upon turning the key, the handle 20 bearing the lock mechanism 22 moves under spring pressure from the locked position illustrated in FIG. 6 through the handle-movement opening 96 and into the operating position illustrated in FIG. 7. In the latter position, wherein the handle 20 is spaced outwardly from the casing 14, the handle may be manipulated by grasping the grip 56, for opening and closing the door or other closure on which the lock 10 is mounted. The relatively small and compact nature of the protective cover requires no alteration of existing equipment for its use. Thus, the flange 30 is moved about ⅛ inch away from the panel 24 in the illustrative embodiment, and the corresponding shifting of the receptacle 26 and the lock shaft 19 or other shaft readily is accommodated. Alternatively, the dimensions of the lock shaft may be altered correspondingly, if desired.

While a preferred embodiment of the invention has been illustrated and described, and reference has been made to certain changes and modifications which may be made in the embodiment, it will be apparent that further changes and modifications may be made therein within the spirit and scope of the invention. It is intended that all such changes and modifications be included within the scope of the appended claims.

I claim:

1. A protective cover for a handle lock, said lock including a handle housing adapted to be mounted on a closure and having a tubular receptacle which extends into the closure when mounted, a flange projecting laterally outwardly from the receptacle for supporting the housing thereby on the outer surface of the closure, and means cooperative with fastening means for securing the housing to the closure; a closure handle having a stem received in said receptacle and a grip on the outer end of the stem for manual operation of the handle, said handle being movable inwardly and outwardly with respect to said housing between an inner locked position wherein the grip is adjacent to said flange and an outer operating position; and locking means carried by said handle and cooperative in said locked position with means on said housing for locking the handle to the housing, said cover comprising:

a mounting plate having an opening for receiving said receptacle extending therethrough when the cover is in use with the lock mounted on a closure, with the plate engaging the inner surface of said flange to secure the plate to the closure;

a one-piece casing adapted to be mounted on said plate in said use to continuously surround said flange and said grip in said locked position, said casing having a handle-movement opening access to said locking means in said locked position and permitting movement of said handle between said locked and operating positions, said grip being disposed outwardly of said casing in said operating position, said casing also being adapted to lie closely adjacent to said grip around the periphery of said handle-movement opening in said locked position for preventing insertion and operation of a prying tool behind said grip; and means for rigidly connecting said casing to said plate.

2. A cover as defined in claim 1 and wherein said casing further is adapted to enclose said grip in said locked position so as to prevent operative engagement of a pulling tool with the grip.

3. A cover as defined in claim 1 and including means forming in said casing a recess in which said plate is adapted to be received completely in said use.

4. A cover as defined in claim 3 and wherein said connecting means comprise screw means.

5. A cover as defined in claim 1 and wherein said flange includes a peripheral rim portion within which said grip is closely received in said locked position, and said casing is adapted for receiving said rim portion in nesting relation therein in said use.

6. A cover as defined in claim 5 and wherein said casing includes a lip defining the periphery of said handle-movement opening, and said lip is adapted to project laterally over said rim portion in said use.

7. A cover as defined in claim 6 and including means forming in said casing a recess in which said plate is adapted to be received completely in said use.

8. A cover as defined in claim 1 and wherein said casing is a steel forging.

9. In a combination of a handle lock and a protective cover, said lock including a handle housing adapted to be mounted on a closure and having a tubular receptacle which extends into the closure when mounted, a flange projecting laterally outwardly from the receptacle for supporting the housing thereby on the outer surface of the closure, and means cooperative with fastening means for securing the housing to the closure; a closure handle having a stem received in said receptable and a grip on the outer end of the stem for manual operation of the handle, said handle being movable inwardly and outwardly with respect to said housing between an inner locked position wherein the grip is adjacent to said flange and an outer operating position; and locking means carried by said handle and cooperative in said locked position with means on said housing for locking the handle to the housing, an improved protective cover which comprises:

a mounting plate having a receptacle-receiving opening, said receptacle extending through said opening when the cover is in use with the lock mounted on a closure, with the plate engaging the inner surface of said flange to secure the plate to the closure;

a one-piece casing adapted to be mounted on said plate in said use to continuously surround said flange and said grip in said locked position, said casing having a handle-movement opening affording access to said locking means in said locked position and permitting movement of said handle between said locked and operating positions, said grip being disposed outwardly of said casing in said operating position, said casing also being adapted to lie closely adjacent to said grip around the periphery of said handle-movement opening in said locked position for preventing inserting and operation of a prying tool behind said grip; and means for rigidly connecting said casing to said plate.

10. A combination as defined in claim 9 and wherein said casing further is adapted to enclose said grip in said locked position so as to prevent operative engagement of a pulling tool with the grip.

11. A combination as defined in claim 9 and including means forming in said casing a recess in which said plate is received completely in said use.

12. A combination as defined in claim 11 and wherein said connecting means comprise screw means.

13. A combination as defined in claim 9 and wherein said flange includes a peripheral rim portion within which said grip is closely received in said locked position, and said casing is adapted for receiving said rim portion in nesting relation therein in said use.

14. A combination as defined in claim 13 and wherein said casing includes a lip defining the periphery of said handle-movement opening, and said lip projects laterally over said rim portion in said use.

15. A combination as defined in claim 14 and including means forming in said casing a recess in which said plate is received completely in said use.

16. A combination as defined in claim 15 and wherein said casing is a steel forging.

* * * * *